US006405620B2

(12) United States Patent
Liao

(10) Patent No.: US 6,405,620 B2
(45) Date of Patent: Jun. 18, 2002

(54) STRUCTURE FOR ROTATING AND LOCATING SCREWDRIVER HANDLE

(76) Inventor: Sang-Yuan Liao, No. 2, 14th Road, Ta-Li Industrial District, Tai-Pin City, Taichung Hsing (TW)

( * ) Notice: Subject to any disclaimer, the term of this patent is extended or adjusted under 35 U.S.C. 154(b) by 0 days.

(21) Appl. No.: 09/882,714

(22) Filed: Jun. 14, 2001

(30) Foreign Application Priority Data

Jun. 14, 2000 (CN) ..... 00239236 U

(51) Int. Cl.[7] ..... B25G 1/06
(52) U.S. Cl. ..... 81/177.7; 81/489
(58) Field of Search ..... 81/177.6, 177.7, 81/177.9, 489, 438, 440, 64

(56) References Cited

U.S. PATENT DOCUMENTS 943,757 A * 12/1909 Stephens ..... 81/177.9
948,946 A * 2/1910 Wittman ..... 81/177.9
2,705,897 A * 4/1955 Kentish ..... 81/177.9
3,270,597 A * 9/1966 Neff et al. ..... 81/177.9
4,170,909 A * 10/1979 Wagner ..... 81/63.2
5,280,738 A * 1/1994 Liou ..... 81/20
5,515,754 A * 5/1996 Elkins ..... 81/177.9

* cited by examiner

*Primary Examiner*—Joseph J. Hail, III
*Assistant Examiner*—David B Thomas
(74) *Attorney, Agent, or Firm*—W. Wayne Liauh

(57) ABSTRACT

A screwdriver comprises a handle which is provided with a head end portion and a grip portion pivoted with the head end portion. The head end portion has a pivoting block which is provided with an axial slide slot for receiving a slide block. A spring is disposed between the slide block and the axial slide slot. A press block is joined with the slide block such that the press block is put through an insertion hole extending through the axial slide slot. The grip portion is provided with a receiving space for accommodating a retaining plate having a plurality of toothed sots. The slide block is controlled by the press block to engage or disengage the toothed slots of the retaining plate, thereby adjusting and locating the application force angle of the grip portion.

3 Claims, 10 Drawing Sheets

STRUCTURE FOR ROTATING AND LOCATING SCREWDRIVER HANDLE

FIELD OF THE INVENTION

The present invention relates generally to a screwdriver, and more particularly to a rotating and locating structure of the handle of the screwdriver.

BACKGROUND OF THE INVENTION

The do-it-yourself (DIY) hand tools are gaining popularity among the consumers. Take the screwdriver as an example. In order to enhance the competitiveness of the screwdriver, the innovative design of appearance and function of the screwdriver is vitally important. As shown in FIGS. 1—1 and 1–2, the prior art screwdrivers are formed of a handle 1 and a blade 2. In operation, the handle 1 is held in the hand of a user of the screwdriver such that the handle 1 is rotated by the palm pressing against the top end of the handle 1, thereby enabling the tip of the blade 2 to work on a screw. In light of constant frictional contact of the palm with the top end of the handle 1, the palm is susceptible to skin-swelling or skin rupture. In the event that the screw is hard to work on, an extra effort is called for to enable the blade 2 to work on the screw. With the purpose of providing the remedy, a screwdriver with two-way handle wad introduced to the market, as shown in FIGS. 2-1 and 2—2. The screwdriver handle has a handle main body 3 and a grip seat 4 which is pivoted at one end with the handle main body 3 by a pivot 5 such that the grip seat 4 can be turned on the pivot 5 by the hand of a user. However, the screwdriver is devoid of a locating structure between the handle main body 3 and the grip seat 4. As a result, when the grip seat is urged by the palm of the user's hand in the process of rotating the grip seat, the grip seat is apt to turn toward the handle main body, thereby resulting in failure of the screwdriver to work on a screw. It is therefore readily apparent that the prior art screwdriver described above is in need of a structure for locating the grip seat.

SUMMARY OF THE INVENTION

The primary objective of the present invention is to provide a screwdriver with a locating structure for adjusting the angle of application force of the grip portion of the handle of the screwdriver, thereby resulting in the improvement on the function of the screwdriver.

The foregoing objective of the present invention is attained by a screwdriver handle comprising a head end portion and a grip portion. The head end portion is provided in one side with a pivoting block. The grip portion is provided in one side with a recessed slot corresponding in location to the pivoting block. The pivoting block is provided in one side with an axial slide slot for receiving a slide block. Located between the slide block and the axial slide slot is a spring. The slide block is provided with a stepped rod for the clamp of a press block to be put through the insertion hole of the axial slide slot. The grip portion is provided with a receiving space corresponding in location to the axial slide slot for receiving a retaining plate having a plurality of toothed slots. A locating rod is put through the holes of the grip portion and the head end portion. When the handle is in the state of normal use, the stop face of the slide block is urged by the spring such that other end thereof is inserted into the toothed slot of the retaining plate, thereby locating the head end portion and the grip portion. The angle of application force of the grip portion is adjusted by pushing the press block in reverse to compress the spring, so as to cause the side end of the slide block to move away from the toothed slot of the retaining plate. The grip portion is no longer retained and can be rotated freely for an appropriate angle of application force. Upon completion of the adjustment of the application force angle, the press block is let go such that the press block is forced by the spring force of the spring into the toothed slot which has changed its angle. As a result, the grip portion is located at the desired angle of application force.

The structure and the function of the present invention will be more readily understood upon a thoughtful deliberation of the following detailed description of a preferred embodiment of the present invention with reference to the accompanying drawings.

BRIEF DESCRIPTION OF THE DRAWINGS

FIG. 1–2 shows a schematic view of the prior art screwdriver handle in use.

FIG. 2-1 shows a schematic view of a second prior art screwdriver handle.

FIG. 2—2 shows a schematic view of the second prior art screwdriver handle in use.

FIG. 3-1 shows a partial schematic view of FIG. 3.

DETAILED DESCRIPTION OF THE INVENTION

Figures 1, 2:
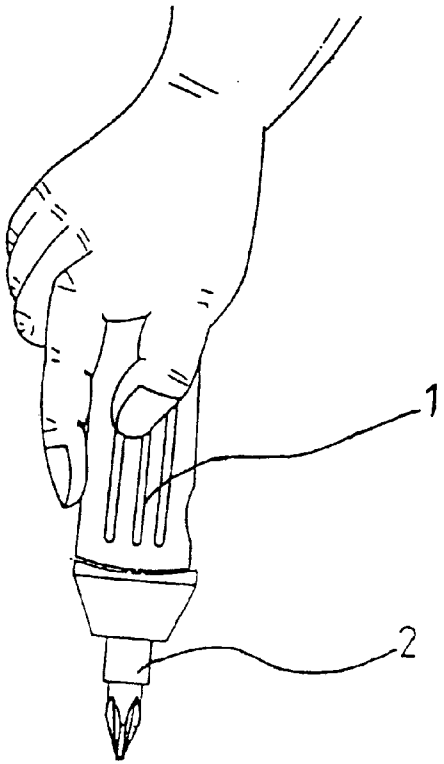
FIG. 1-2 PRIOR ART
Figure 1:
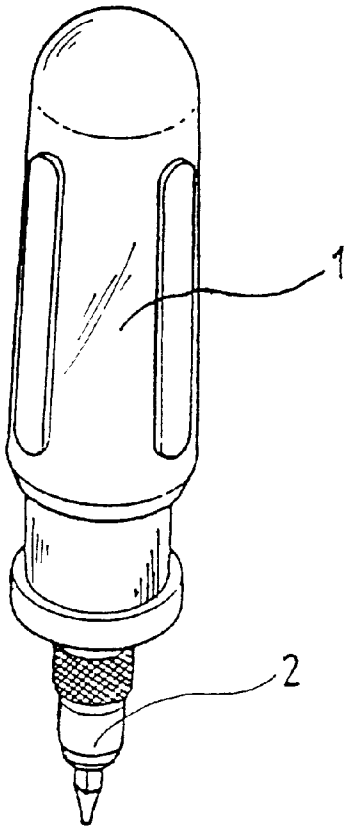
FIG. 1-1 PRIOR ART
FIG. 1—1 shows a schematic view of a prior art screwdriver handle.
Figure 2:
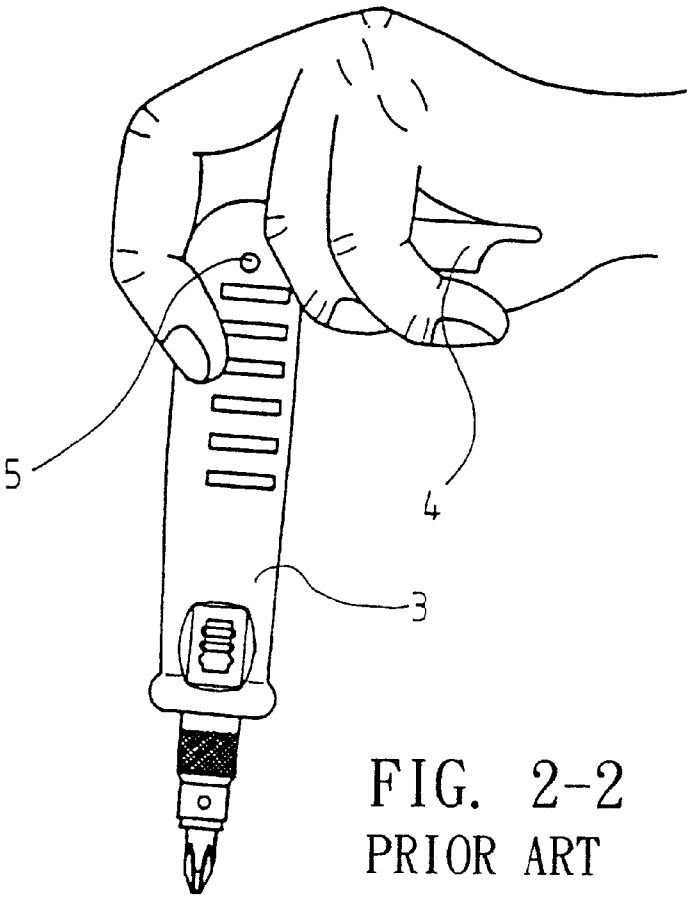
FIG. 2-2 PRIOR ART
Figures 1, 2:
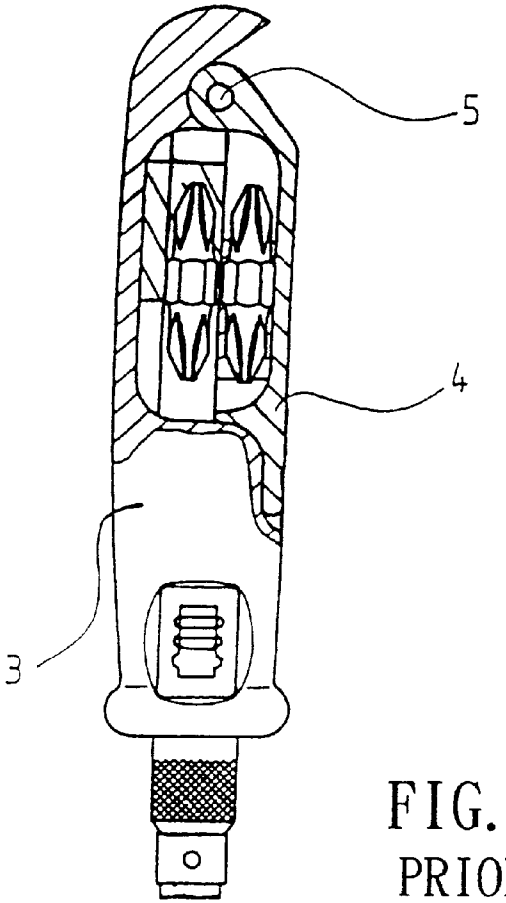
FIG. 2-1 PRIOR ART
Figure 3:
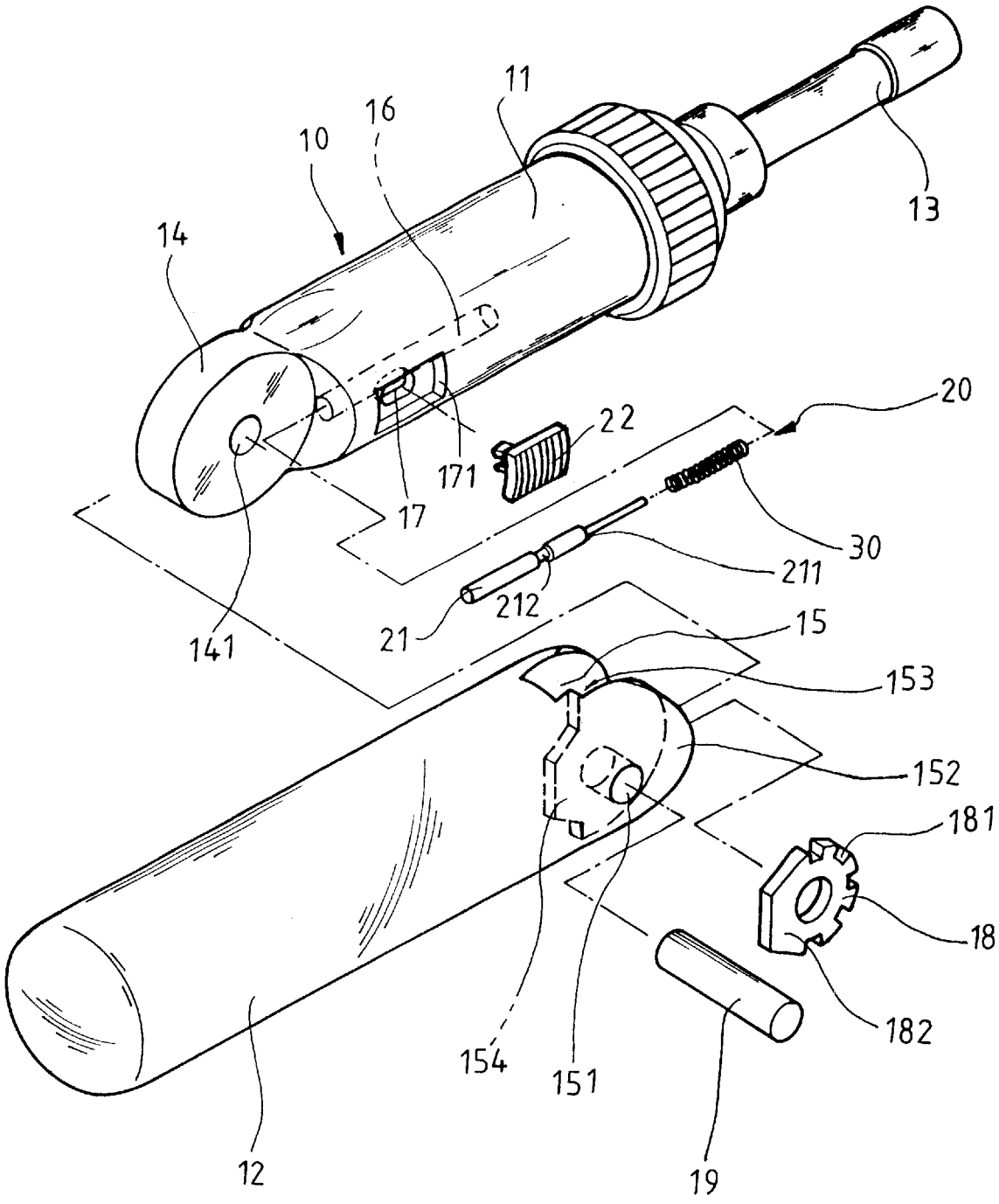
FIG. 3 shows an exploded view of the present invention.
Figures 1, 3:
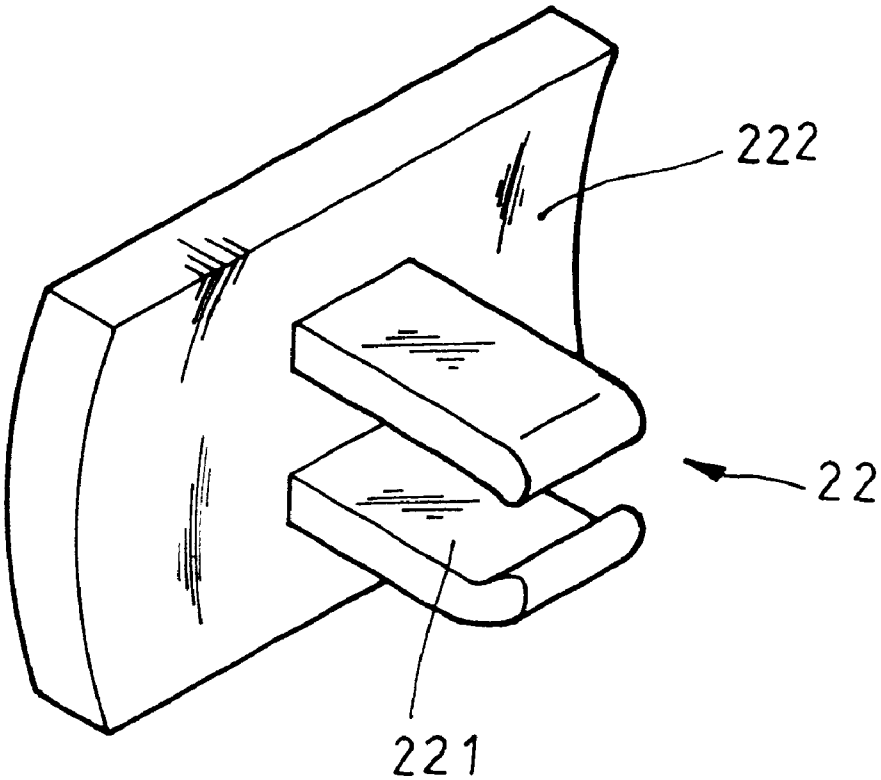
Figure 4:
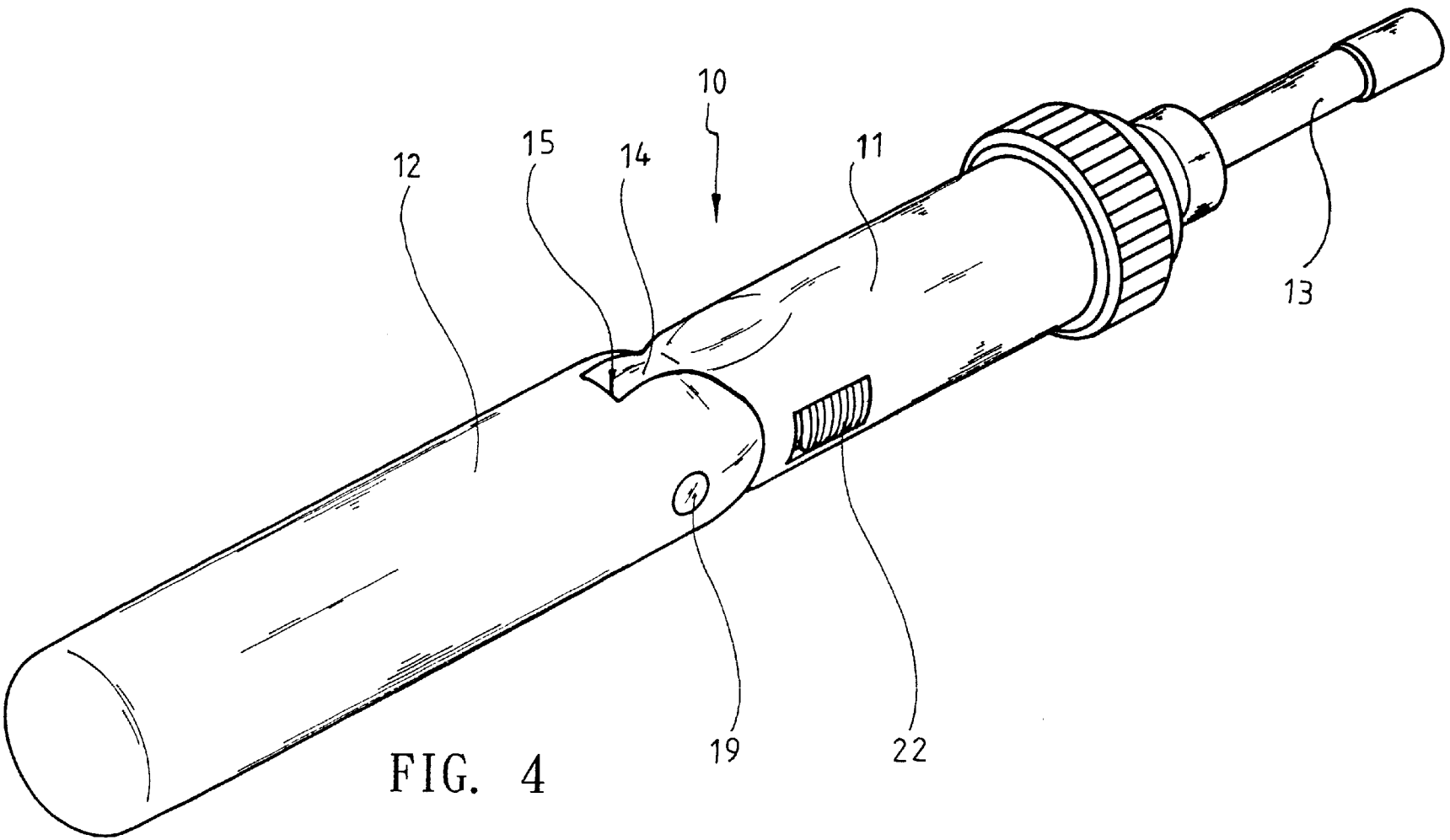
FIG. 4 shows a perspective view of the present invention.

As shown in FIGS. 3–4, the present invention comprises a handle 10 and a locating member 20.

The handle 10 is provided with a head end portion 11 and a grip portion 12. The head end portion 11 has one end which is provided with a shank 13, and other end which is provided with a pivoting block 14. The pivoting block 14 is provided with a hole 141. The grip portion 12 is provided with a recessed slot 15 corresponding in location to the pivoting block 14. The recessed slot 15 is provided in the faces of two sides thereof with a hole 151 corresponding in location to the hole 141 of the pivoting block 14. The head end portion 11 is provided in the side of the pivoting block 14 with an axial slide slot 16 with is in turn provided with an insertion hole 17 perpendicular to the outer portion and having a sunk slot 171. The grip portion 12 is provided with a receiving space 153 corresponding in location to the face 152 of the axial slide slot 16. The receiving space 153 is intended to accommodate a retaining plate 18 which is provided with a plurality of toothed slots 181. The retaining plate 18 is further provided with a protrusion 182 which is located in the side devoid of the toothed slots 181. The protrusion 182 can be inserted into a receiving slot 154 of the receiving space 153, so as to prevent the retaining plate 18 from turning. The head end portion 11 and the grip portion 12 are pivoted together by a locating rod 19 which is put through the hole 141 of the pivoting block 14 and the hole 151 of the recessed slot 15.

The locating member 20 is formed of a slide block 21 and a press block 22. The slide block 21 is disposed in the axial slide slot 16 of the head end portion 11 and is provided with a stop surface 211. A spring 30 is disposed between the stop surface 211 and the axial slide slot 16. The stop surface 211 is provided in other side with a stepped rod 212 which is held by a clamp 221 of the press block 22. The face 222 of other side of the clamp 221 of the press block 22 is disposed in the sunk slot 171 of the insertion hole 17.

Figure 5:
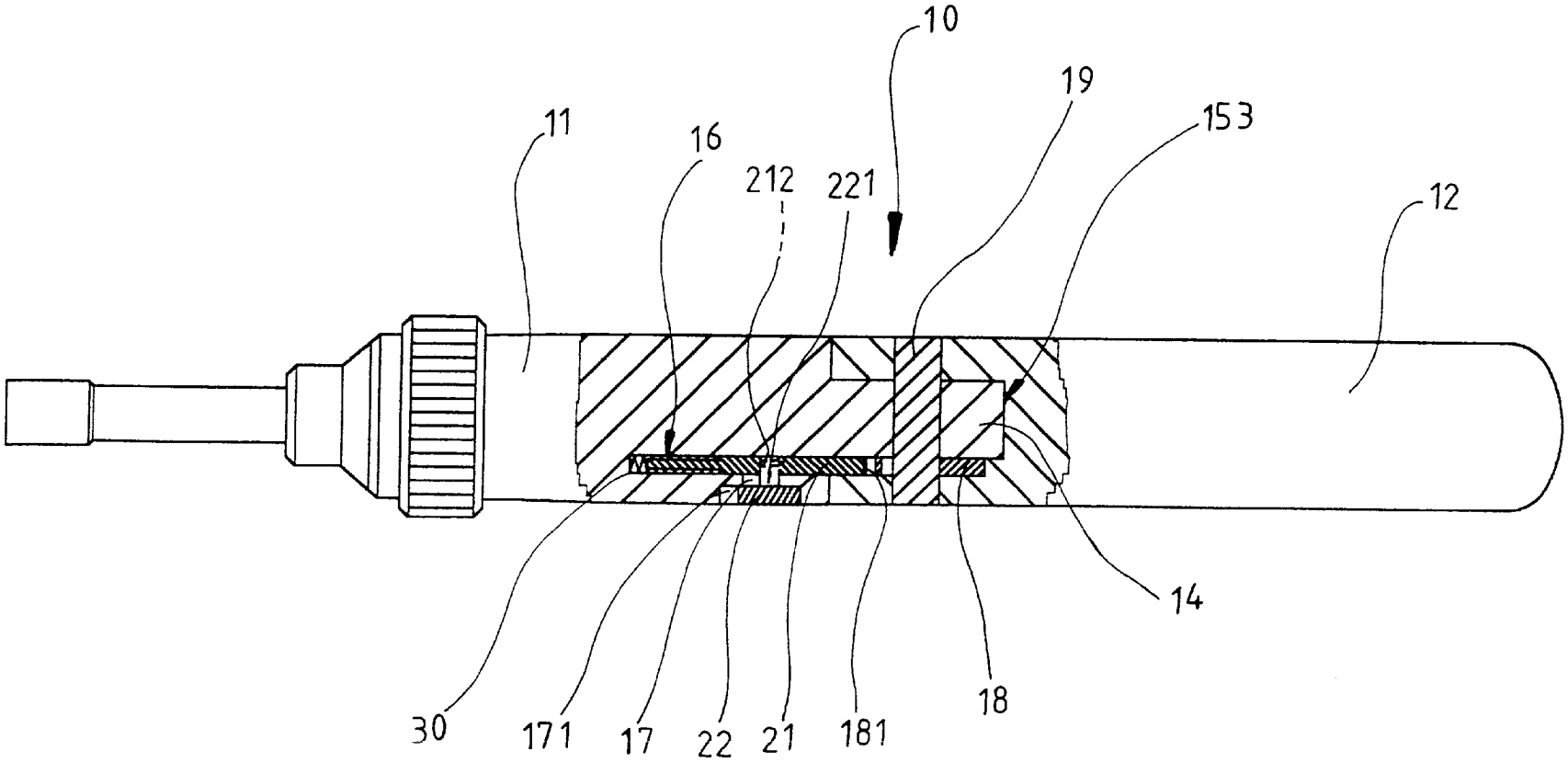
FIG. 5 shows a sectional schematic view of the present invention.
Figure 6:
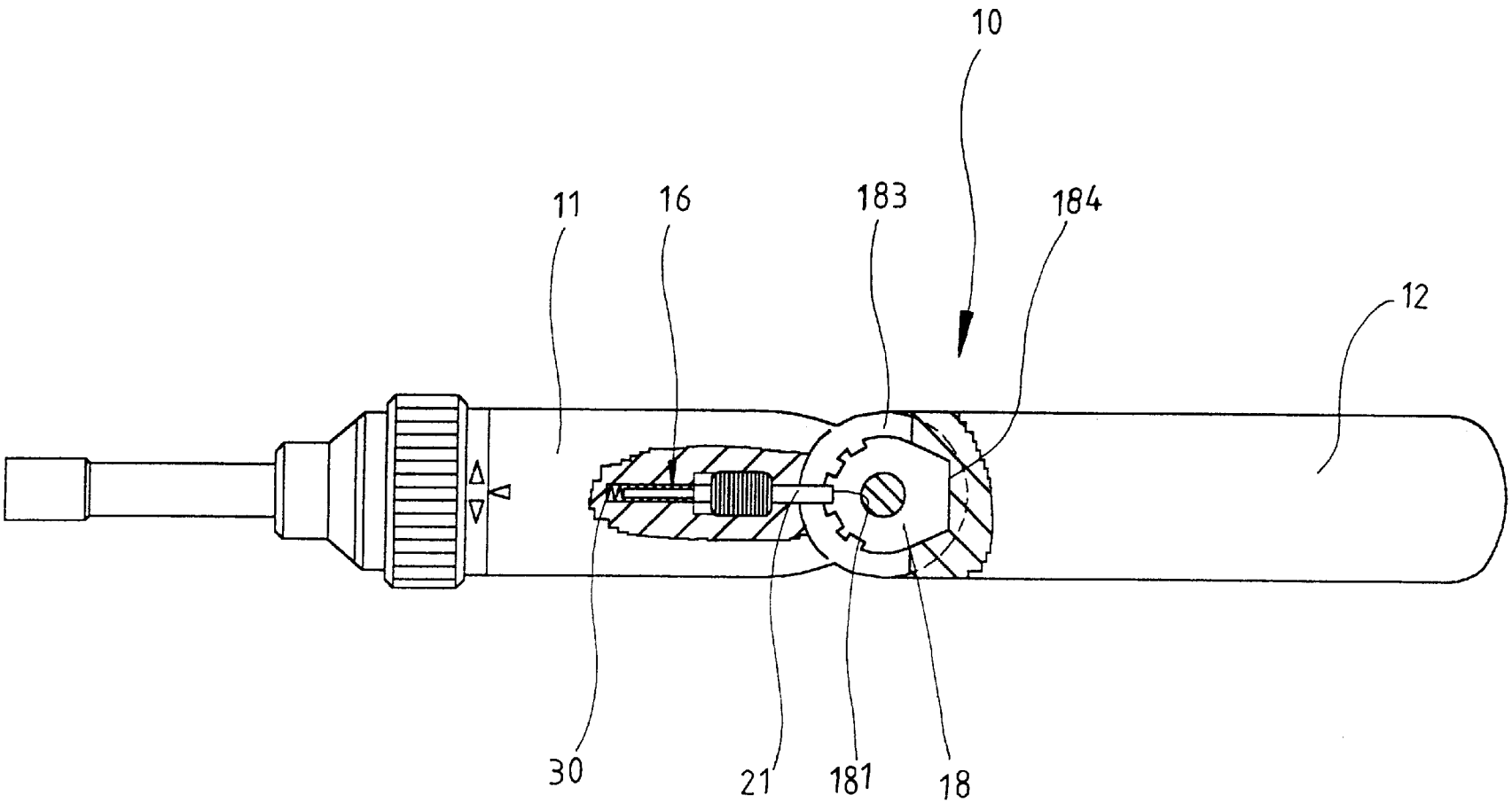
FIG. 6 shows another sectional schematic view of the present invention.
Figure 7:
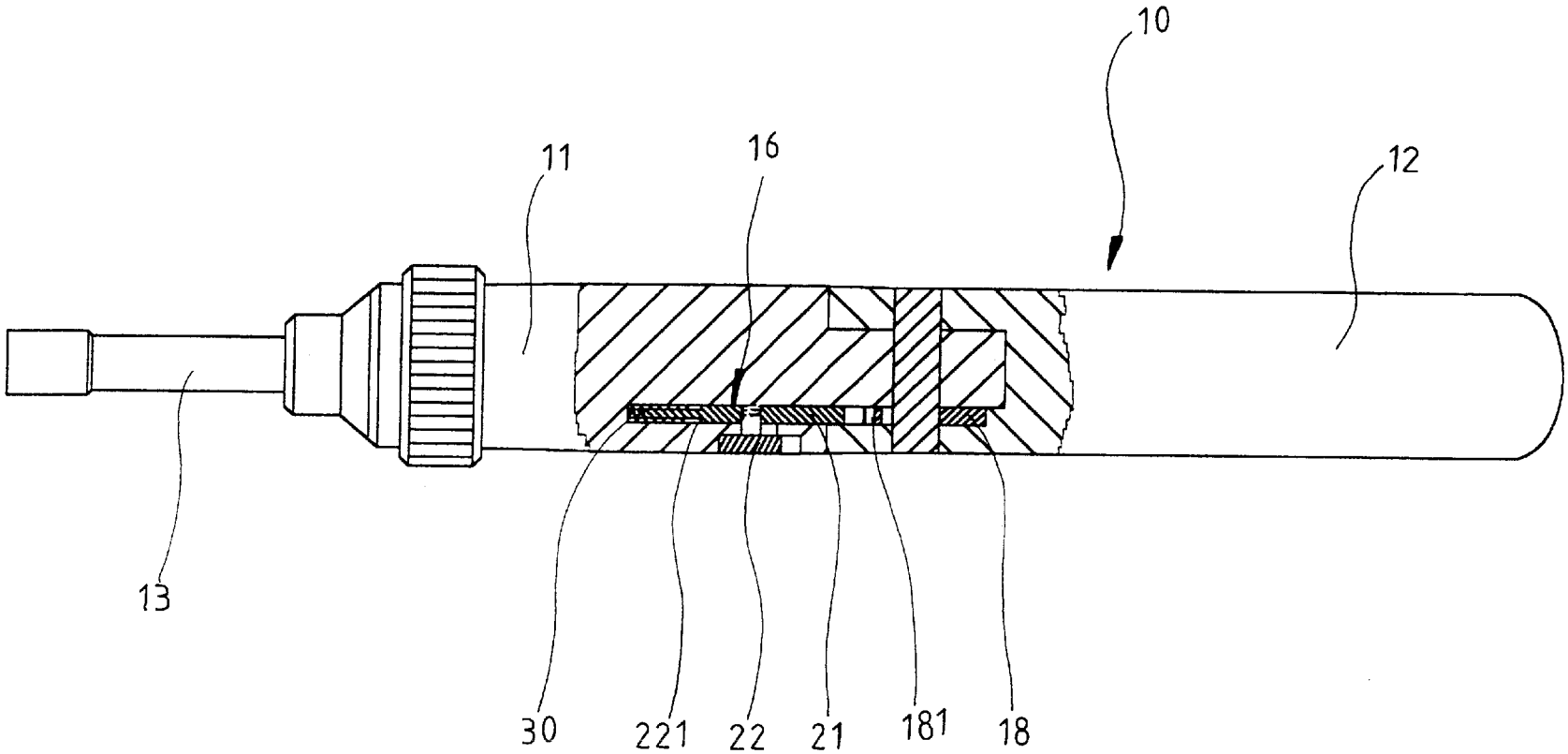
FIG. 7 is a sectional schematic view of the present invention to show the locating rod in action.
Figure 8:
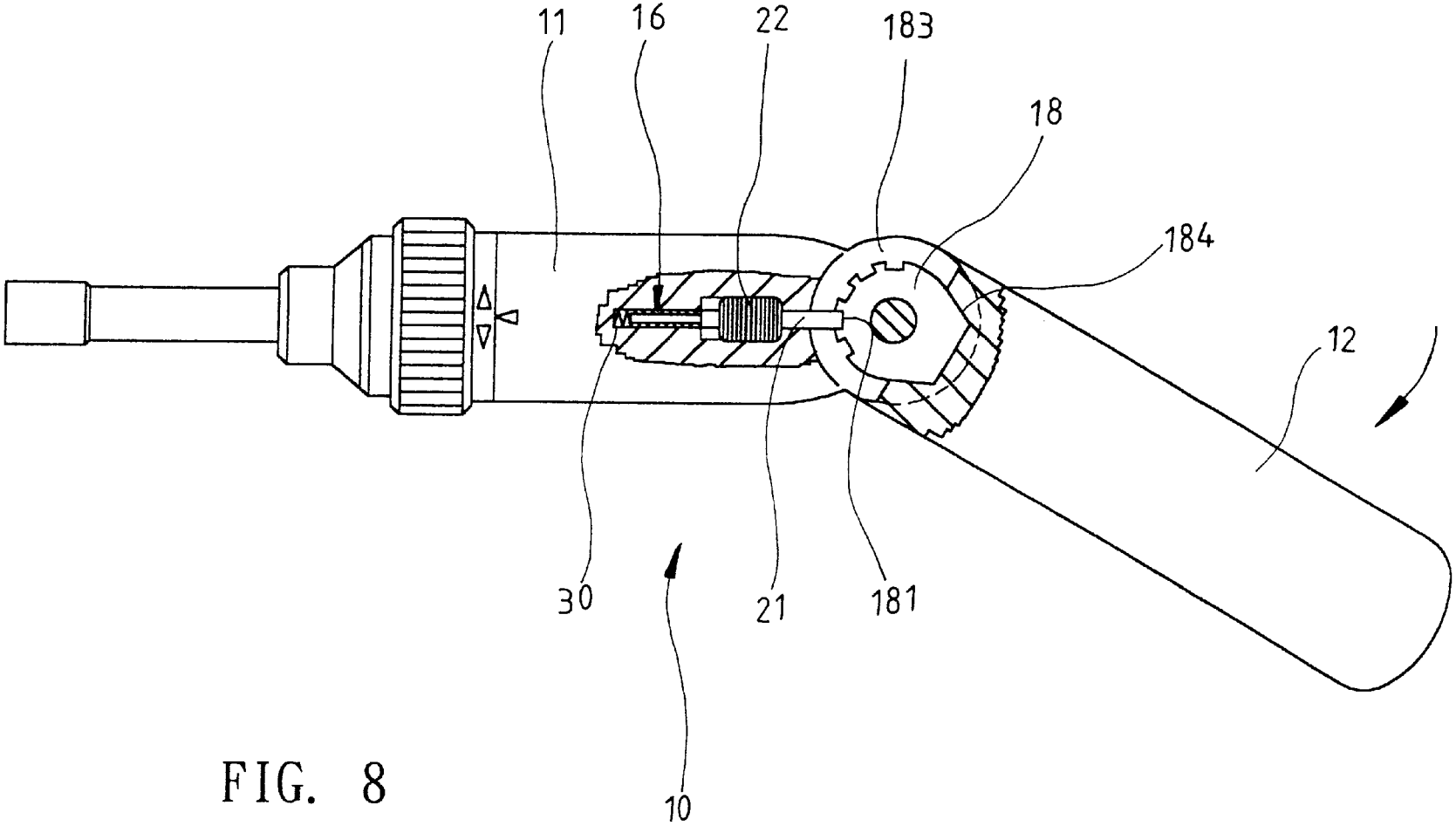
FIG. 8 shows a sectional schematic view of the angle adjustment of the handle of the present invention.
Figure 9:
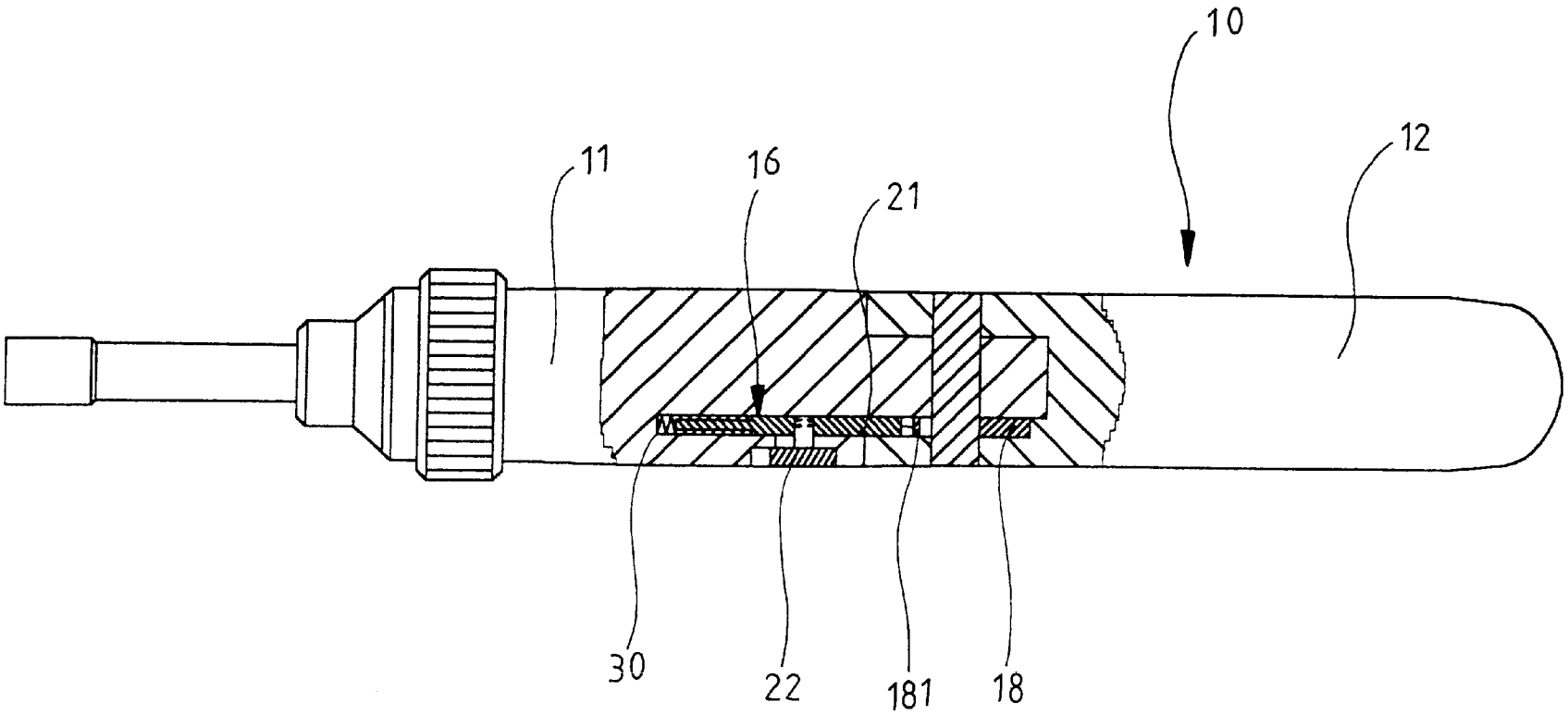
FIG. 9 shows a sectional schematic view of the locating of the grip portion of the handle of the present invention.

As shown in FIGS. 5 and 6, when the handle 10 is in the state of the normal use, the slide block 21 of the locating member 20 is located in the axial slide slot 16 of the head end portion 11 such that the slide block 21 is urged by the spring 30 to extend outwards to be in the toothed slot 181 of the retaining plate 18, thereby locating the grip portion 12 and the head end portion 11. Now referring to FIG. 7, the application force angle of the grip portion 12 is adjusted by pressing the press block 22 to displace in the direction toward the shank 13. In the meantime, the slide block 21 is actuated to displace in the same direction such that the stop surface 211 of the slide block 21 compresses the spring 30, and that one end of the slide block 21 is moved away from the toothed slot 181 of the retaining plate 18. As a result, the slide block 21 is relieved of the locating effect to enable the grip portion 12 to turn freely. Now referring to FIGS. 8 and 9, the gripping angle of the hand of a user of the screwdriver is adjusted such that the grip portion 12 and the head end portion 11 form therebetween an appropriate angle. The protrusion 182 is located in the receiving slot 154 to enable the retaining plate 18 to rotate along with the grip portion 12 in motion, thereby enabling the slide block 21 to be inserted into the toothed slot 181 which is located at another angular position. As the press block 22 is let go , the slide block 21 is forced by the spring force of the spring 30 to return to its original position. In the meantime, another end of the slide block 21 is once again inserted into the corresponding toothed slot 181 of a different locating angle, so as to locate the grip portion 12. As a result, the grip portion 12 and the head end portion 11 are kept at an angle of application force. As an external force exerts on the grip portion 12, the screwdriver handle is turned to work on the screw with a minimum effort, thanks to the grip portion 12 which is capable of increasing the rotational moment of force.

The handle of the present invention can be angularly adjusted to locate the angle of the gripping application force of the grip portion of the handle. As a result, the present invention is capable of working on the screw with a minimum effort made by the user of the present invention.

What is claimed is:

1. A screwdriver rotating and locating structure, comprising:

a handle provided with a head end portion and a grip portion, said head end portion having one end which is provided with a shank, said head end portion having other end which is provided with a pivoting block, said grip portion provided with a recessed slot corresponding in location to said pivoting block, said recessed slot and said pivoting block being provided with a through hole, said pivoting block of said head end portion further provided with an axial slide slot which is in turn provided with an insertion hole, said grip portion being provided in a face thereof with a receiving space corresponding in location to said axial slide slot for accommodating a retaining plate having in one side thereof a plurality of toothed slots and a through hole, said head end portion, said grip portion, and said retaining plate being pivotally located by a locating rod whereby said locating rod is put through said through holes of said pivoting block of said head end portion, said recessed slot of said grip portion, and said retaining plate; and a locating member formed of a slide block and a press block, said slide block being disposed in said axial slide slot and provided with a stop surface, said stop surface and said axial slide slot being provided with a spring disposed therebetween, said press block being put through said insertion of said axial slide slot to join with said slide block such that said press block is exerted on by an external force to control a displacement of said slide block.

2. The screwdriver rotating and locating structure as defined in claim 1, wherein said retaining plate is provided in other side thereof with a protrusion, said other side of said retaining plate being devoid of said toothed slots; wherein said grip portion is provided with a receiving slot corresponding in location to said protrusion of said retaining plate; wherein said protrusion of said retaining plate is located in said receiving slot of said grip portion, so as to prevent said retaining plate from turning.

3. The screwdriver rotating and locating structure as defined in claim 1, wherein said press block has a face and a clamp; wherein said slide block has a stepped rod which is held by said clamp of said press block; wherein said insertion hole of said head end portion is provided with a sunk slot for receiving said face of said press block.

* * * * *